US012201193B2

(12) United States Patent
Qiao

(10) Patent No.: US 12,201,193 B2
(45) Date of Patent: Jan. 21, 2025

(54) AUTOMATIC LOCKING KEYCHAIN

(71) Applicant: Kun Qiao, Shenzhen (CN)

(72) Inventor: Kun Qiao, Shenzhen (CN)

( * ) Notice: Subject to any disclaimer, the term of this patent is extended or adjusted under 35 U.S.C. 154(b) by 0 days.

(21) Appl. No.: 18/459,380

(22) Filed: Aug. 31, 2023

(65) Prior Publication Data

US 2024/0389718 A1 Nov. 28, 2024

(30) Foreign Application Priority Data

May 23, 2023 (CN) ..... 202321255110.3

(51) Int. Cl.
*A44B 15/00* (2006.01)

(52) U.S. Cl.
CPC ..... *A44B 15/007* (2013.01)

(58) Field of Classification Search
CPC ..... A44B 15/007
See application file for complete search history.

(56) References Cited

U.S. PATENT DOCUMENTS 267,112 A * 11/1882 Sanderson ..... F16B 45/035 63/7
862,197 A * 8/1907 Pryor ..... A45C 11/324 24/598.2
1,092,031 A * 3/1914 Earl ..... E05B 37/025 70/459
1,484,532 A * 2/1924 Quigley ..... A44B 15/00 24/598.5
1,724,003 A * 8/1929 Chamberlain ..... F16B 45/024 70/459
5,050,414 A * 9/1991 Huang ..... A44B 15/00 70/459
5,279,021 A * 1/1994 Edgin ..... F16B 45/034 24/664
5,488,848 A * 2/1996 Huang ..... A44B 15/005 63/23
5,983,686 A * 11/1999 Lee ..... A45F 5/02 70/459
8,542,483 B2 * 9/2013 Huang ..... H05K 5/0278 361/740
9,131,758 B2 * 9/2015 Stein ..... A45C 13/001
11,344,087 B2 * 5/2022 Baca ..... A44C 5/2014
D953,733 S * 6/2022 Newcomb ..... D8/14
2008/0072639 A1 * 3/2008 Kurdziel ..... A45F 5/00 224/272

* cited by examiner

*Primary Examiner* — David M Upchurch
(74) *Attorney, Agent, or Firm* — Li & Cai Intellectual Property Office

(57) ABSTRACT

An automatic locking keychain includes a curved plate, a pin shaft at one end of the curved plate, a middle seat rotatably arranged on the pin shaft, a fitting block on the middle seat, and a locking mechanism on a side of the curved plate close to the pin shaft. An end side surface of the fitting block away from the middle seat is attached to another end of the curved plate. The locking mechanism is configured to limit a rotation of the middle seat, and includes a limiting hole at an end of the curved plate close to the pin shaft, a sliding rod sliding inside the limiting hole, and a locking shaft at an end of the sliding rod close to the pin shaft. A locking hole is arranged on the middle seat. A spring is provided between the sliding rod and the limiting hole.

10 Claims, 3 Drawing Sheets

AUTOMATIC LOCKING KEYCHAIN

FIELD OF THE DISCLOSURE

The present disclosure relates to the field of keychains, in particular to an automatic locking keychain.

BACKGROUND OF THE DISCLOSURE

A keychain is an ornament hung on a key ring, which is used to string multiple keys together for easy portability. Existing keychains generally use elastic devices to close and connect the curved hook and the sealing hook to form a complete closed ring, so that the keychain can be hung on the belt without accidental pulling and without falling off. The disadvantage is that when an unexpected force is applied to pull the keychain outward, the curved hook and the sealing hook will be staggered, so that the keychain is easy to open, resulting in the accidental drop of the keychain and the loss of the key.

SUMMARY OF THE DISCLOSURE

The purpose of the present disclosure is to provide an automatic locking keychain, which prevents the keychain from falling off accidentally.

The technical solution adopted to solve the above problems of the present disclosure is as follows.

An automatic locking keychain is provided, which includes a curved plate, a pin shaft arranged at one end of the curved plate, a middle seat rotatably arranged on the pin shaft, a fitting block fixed on the middle seat, and a locking mechanism arranged on a side of the curved plate close to the pin shaft. An end side surface of the fitting block away from the middle seat is attached to another end of the curved plate, and the locking mechanism is configured to limit a rotation of the middle seat.

The locking mechanism includes a limiting hole arranged at one end of the curved plate close to the pin shaft, a sliding rod sliding inside the limiting hole, and a locking shaft arranged at one end of the sliding rod close to the pin shaft. A locking hole is arranged on the middle seat, and a spring is provided between the sliding rod and the limiting hole, so that when the locking shaft is inserted into the locking hole, an opening end of the curved plate is blocked by the fitting block.

A toggle block is fixed on the locking shaft, and the limiting hole has an elongated hole for sliding of the toggle block.

The toggle block is provided with a plurality of anti-slip grooves.

The toggle block slides through a cooperation between the elongated hole of the limiting hole and the toggle block.

An outer end of the locking hole is chamfered.

The curved plate is U-shaped, and the one end of the curved plate where the pin shaft is arranged is a short plate side.

An installation hole is formed through the fitting block.

An extension plate extends from an end of the fitting block away from the pin shaft to an inner end of the curved plate.

One rounded corner is arranged on an end of the fitting block away from the extension plate, and the extension plate is provided with another rounded corner.

Figure 1:
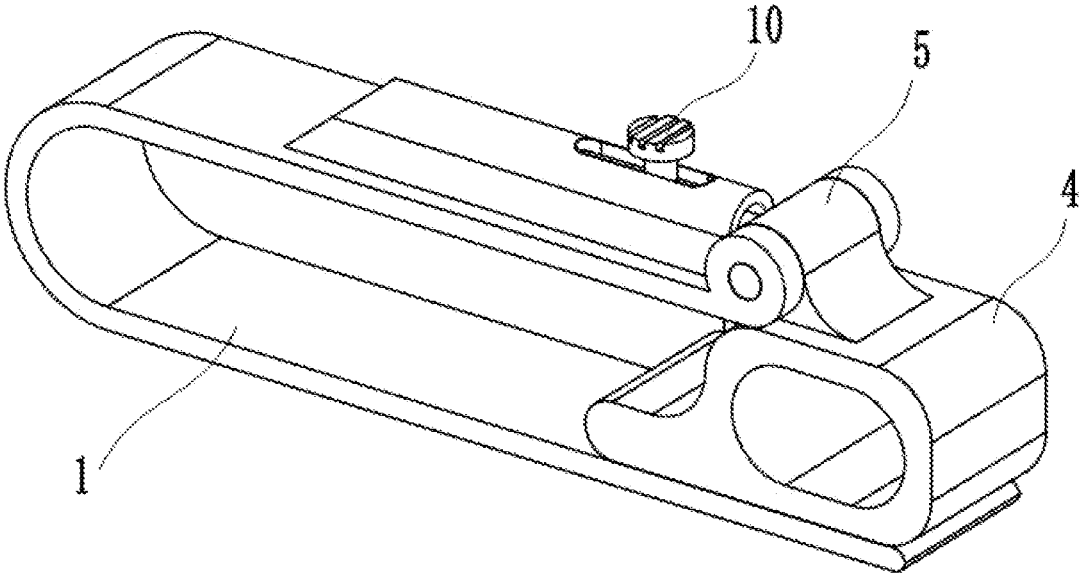
FIG. 1 and FIG. 2 are overall schematic structural diagrams of an automatic locking keychain.

Reference numeral: 1, curved plate; 2, limiting hole; 3, pin shaft; 4, fitting block; 5, middle seat; 6, installation hole; 7, locking hole; 8, sliding rod; 9, locking shaft; 10, toggle block; and 11, spring.

DETAILED DESCRIPTION OF THE EXEMPLARY EMBODIMENTS

Figure 2:
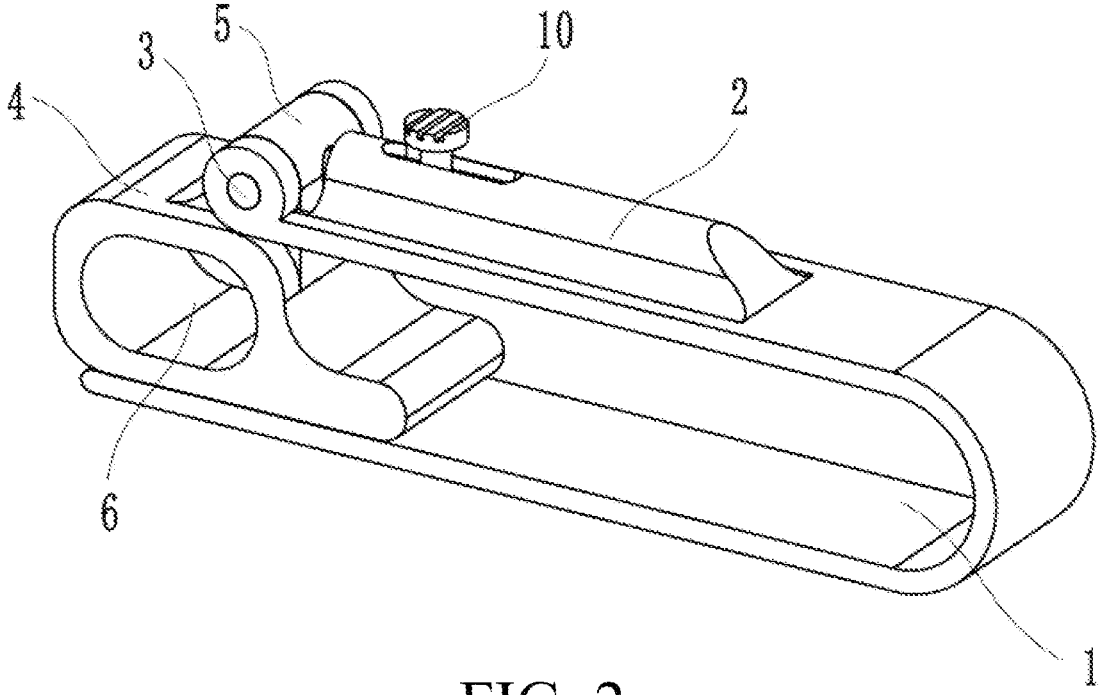
Figure 3:
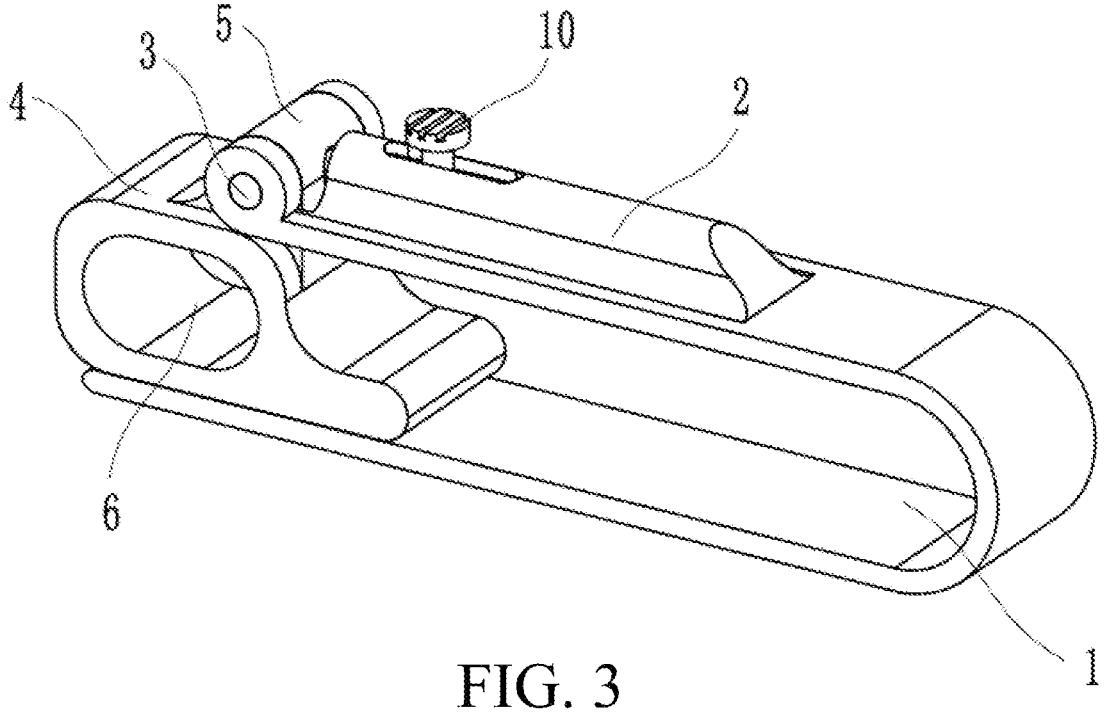
FIG. 3 is a schematic structural diagram illustrating when one end of the automatic locking keychain is opened.
Figure 4:
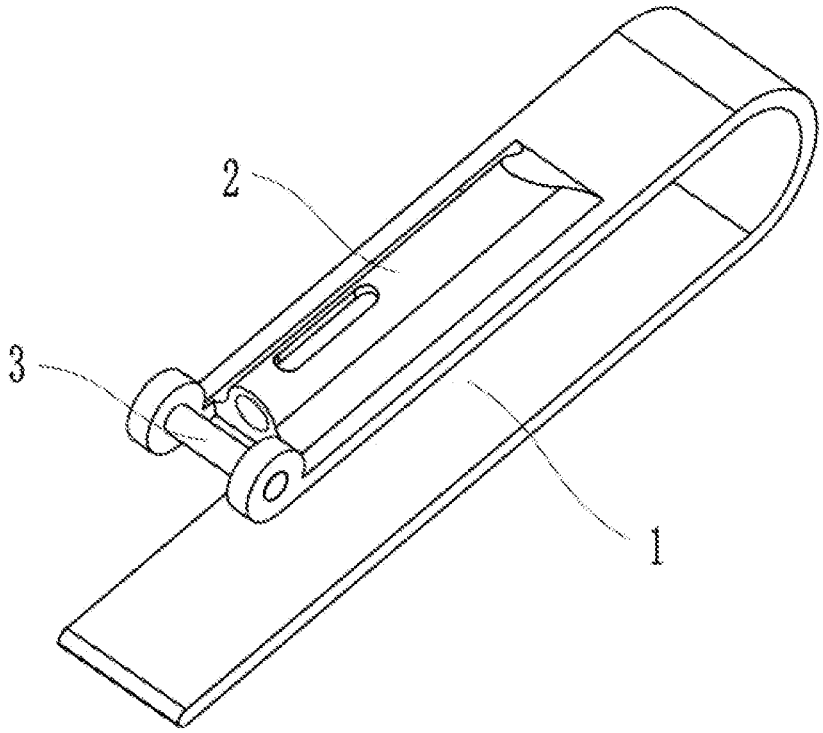
FIG. 4 is a schematic structural diagram of a curved plate.
Figure 5:
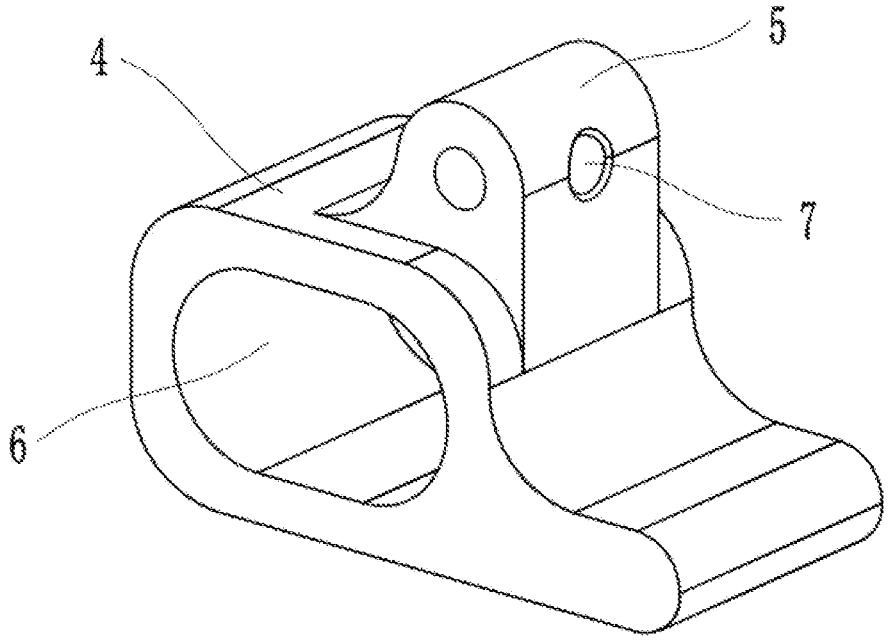
FIG. 5 is a schematic structural diagram of a fitting block.
Figure 6:
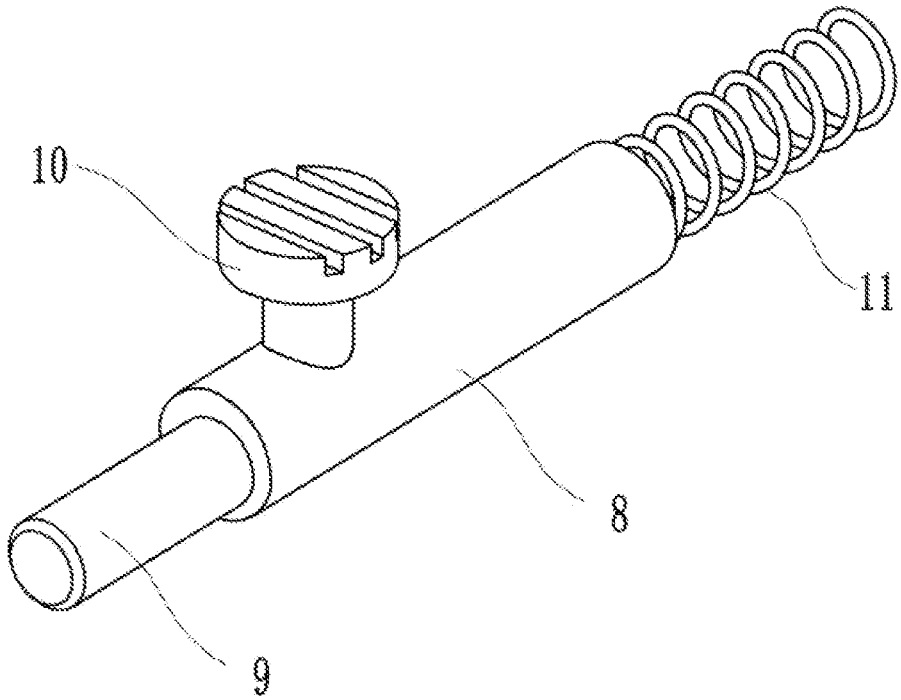
FIG. 6 is a schematic structural diagram of a sliding rod.

As shown in FIGS. 1 to 6, the embodiment of the present disclosure is described in detail.

An automatic locking keychain is provided, which includes a curved plate 1, a pin shaft 3, a fitting block 4, and a middle seat 5. The pin shaft 3 penetrates the curved plate 1 and is arranged at one end of the curved plate 1, the middle seat 5 is rotatably arranged on the pin shaft 3, and the fitting block 4 is fixed on the middle seat 5. By virtue of an elasticity of the curved plate 1 itself, one end of the curved plate 1 will drive the fitting block 4 to press against a surface of another end of the curved plate 1, and one end side surface of the fitting block 4 away from the middle seat 5 is attached to the another end of the curved plate 1. A locking mechanism is arranged on a side of the curved plate 1 close to the pin shaft 3, and the locking mechanism is configured to limit a rotation of the middle seat 5.

When in use, the elasticity of the curved plate 1 is overcome, and the fitting block 4 is rotated around the pin shaft 3 as an axis, so that the fitting block 4 is rotated out between the two ends of the curved plate 1 and an opening of the curved plate 1 is exposed out, and the curved plate 1 can be put on a belt or a trouser belt through the opening. Then the fitting block 4 is rotated so that the fitting block 4 squeezes the two ends of the curved plate 1 to deform the curved plate 1, which enables the one end side surface of the fitting block 4 away from the middle seat 5 to attach to the another end of the curved plate 1 again. At the time, the opening of the curved plate 1 is perfectly blocked by the fitting block 4, and the elastic force of the curved plate 1 effectively avoids any rotation of the fitting block 4, so as to ensure the continuation of the blocking state. Therefore, the curved plate 1 is prevented from falling off freely from the belt or the trouser belt, and a key hanging on the curved plate 1 is avoided from being lost.

When it is needed to take off the curved plate 1 from the belt or the trouser belt, the curved plate 1 is pulled forcefully to make the belt or the trouser belt press against the fitting block 4, so that the fitting block 4 can overcome the elastic force of the curved plate 1 and rotate to an outside. Accordingly, the opening of the curved plate 1 can be exposed out, so as to achieve a purpose of quickly removing the curved plate 1 from the belt or the trouser belt.

In addition, the rotation of the middle seat 5 can be limited by the locking mechanism, which effectively limits the rotation of the fitting block 4 at the opening of the curved plate 1, and prevents the keychain from accidentally falling off due to an external force, so as to achieve a purpose of preventing the accidental falling off of the keychain.

Reference is made to FIGS. 1 to 6, in which the lock mechanism includes a limiting hole 2, a locking hole 7, a sliding rod 8, a locking shaft 9, and a spring 11. The limiting hole 2 is fixed on an end of the curved plate 1 close to the pin shaft 3, the sliding bar 8 slides in the limiting hole 2, the locking shaft 9 is fixed on an end of the sliding rod 8 close to the pin shaft 3, the locking hole 7 is arranged on the middle seat 5, and the spring 11 is arranged between the sliding bar 8 and the limiting hole 2, so that the locking shaft 9 can be inserted into the locking hole 7. At the time, the fitting block 4 blocks the opening of the curved plate 1.

When the end side surface of the fitting block 4 away from the middle seat 5 is attached to the another end of the curved plate 1, and the opening of the curved plate 1 is blocked, the locking hole 7 on the middle seat 5 corresponds to the locking shaft 9, and an elastic force of the spring 11 will push the sliding rod 8 to slide out from the limiting hole 2 and then drive the locking shaft 9 to slide into the locking hole 7 to lock the middle seat 5, so that the middle seat 5 cannot rotate on the pin shaft 3, and locking of the opening end of the curved plate 1 is formed on the fitting block 4, so as to ensure that the curved plate 1 cannot be removed from the belt or the trouser belt without pulling the locking shaft 9 out of the locking hole 7.

Reference is made to FIGS. 1 to 6, in which a toggle block 10 is fixed on the locking shaft 9, and the limiting hole 2 has an elongated hole for sliding of the toggle block 10.

Through the arrangement of the toggle block 10, the toggle block 10 can be toggled on an outside of the limiting hole 2, and then the sliding rod 8 is driven to slide in the limiting hole 2, so that the locking shaft 9 slides out of the locking hole 7.

Further, by arranging a plurality of anti-slip grooves on the toggle block 10, a friction force between the toggle block 10 and a finger can be increased, which is convenient for the toggle block 10 to drive the sliding rod 8 to slide in the limiting hole 2.

Further, the toggle block 10 slides through a cooperation between the elongated hole of the limiting hole (2) and the toggle block (10). A diameter of the toggle block 10 is set to be equivalent to a width of the elongated hole provided on the limiting hole 2, so as to prevent the sliding rod 8 from rotating in the limiting hole 2 to make the toggle block 10 change direction, which leads to the toggle block 10 being not easy to toggle.

Further, an outer end of the locking hole 7 is chamfered, which is convenient for the locking shaft 9 to be inserted into the locking hole 7.

Further, the curved plate 1 is U-shaped, and the one end where the pin shaft 3 is arranged is a short plate side. The U-shaped arrangement for the curved plate 1 facilitates a suspension of the curved plate 1 to suit the belt.

Further, the installation hole 6 is penetratingly arranged on the fitting block 4, which is convenient to hang an elastic ring on the installation hole 6, and then hang the key through the elastic ring.

Further, an extension plate extends from an end of the fitting block 4 away from the pin shaft 3 to an inner end of the curved plate 1, one rounded corner is arranged on one end of the fitting block 4 away from the extension plate, and the extension plate is provided with another rounded corner.

By virtue of the arrangement of the extension plate, an attachment area between the fitting block 4 and an inner end surface of the curved plate 1 is ensured to be increased, and a stability of the fitting block 4 and the curved plate 1 is ensured. In addition, by virtue of the arrangement of the rounded corner, it is convenient for the fitting block 4 to rotate at the opening, while ensuring aesthetics.

What is claimed is:

1. An automatic locking keychain, comprising: a curved plate (1), a pin shaft (3) arranged at one end of the curved plate (1), a middle seat (5) rotatably arranged on the pin shaft (3), a fitting block (4) fixed on the middle seat (5), and a locking mechanism arranged on a side of the curved plate (1) adjacent to the pin shaft (3), wherein an end side surface of the fitting block (4) away from the middle seat (5) is attached to another end of the curved plate (1), and the locking mechanism is configured to limit a rotation of the middle seat (5).

2. The automatic locking keychain according to claim 1, wherein the locking mechanism comprises a limiting hole (2) arranged at one end of the curved plate (1) adjacent to the pin shaft (3), a sliding rod (8) sliding inside the limiting hole (2), and a locking shaft (9) arranged at one end of the sliding rod (8) adjacent to the pin shaft (3), wherein a locking hole (7) is arranged on the middle seat (5), and a spring (11) is provided between the sliding rod (8) and the limiting hole (2), so that when the locking shaft (9) is inserted into the locking hole (7), an opening end of the curved plate (1) is blocked by the fitting block (4).

3. The automatic locking keychain according to claim 2, wherein a toggle block (10) is fixed on the locking shaft (9), and the limiting hole (2) has an elongated hole for sliding of the toggle block (10).

4. The automatic locking keychain according to claim 3, wherein the toggle block (10) is provided with a plurality of anti-slip grooves.

5. The automatic locking keychain according to claim 3, wherein the toggle block (10) slides through a cooperation between the elongated hole of the limiting hole (2) and the toggle block (10).

6. The automatic locking keychain according to claim 2, wherein an outer end of the locking hole (7) is chamfered.

7. The automatic locking keychain according to claim 1, wherein the curved plate (1) is a U-shaped plate with a long plate side and a short plate side, and the one end of the curved plate (1) where the pin shaft (3) is arranged is the short plate side.

8. The automatic locking keychain according to claim 1, wherein an installation hole (6) is formed through the fitting block (4).

9. The automatic locking keychain according to claim 1, wherein an extension plate extends from an end of the fitting block (4) away from the pin shaft (3) to an inner end of the curved plate (1).

10. The automatic locking keychain according to claim 9, wherein one rounded corner is arranged on an end of the fitting block (4) away from the extension plate, and the extension plate is provided with another rounded corner.

* * * * *